United States Patent [19]

Bigelow

[11] 4,054,457

[45] Oct. 18, 1977

[54] SILVER HALIDE EMULSIONS CONTAINING HEXATHIOCANE THIONES AS SENSITIZERS

[75] Inventor: John Howard Bigelow, Rochester, N.Y.

[73] Assignee: E. I. Du Pont de Nemours and Co., Wilmington, Del.

[21] Appl. No.: 751,585

[22] Filed: Dec. 17, 1976

[51] Int. Cl.[2] ..... G03C 1/28

[52] U.S. Cl. ..... 96/107

[58] Field of Search ..... 96/107, 109

[56] References Cited

U.S. PATENT DOCUMENTS 3,656,955 4/1972 Ushimaru et al. ..... 96/107

OTHER PUBLICATIONS

F. Asinger, Angew. Chem. Internat. Edit., vol. 6, No. 11, p. 917-919, (1967).

*Primary Examiner*—Won H. Louie, Jr.

[57] ABSTRACT

Photographic silver halide emulsions are prepared which have their sensitivity increased by the addition of hexathiocane thiones having the basic structure:

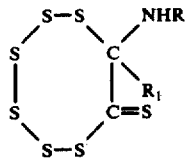

where R is an alkyl, unsaturated alkyl, or a saturated cyclic group, and $R_1$ is aryl or substituted aryl.

7 Claims, No Drawings

SILVER HALIDE EMULSIONS CONTAINING HEXATHIOCANE THIONES AS SENSITIZERS

BACKGROUND OF THE INVENTION

It is known in the art to use sulfur sensitizers or groups of sulfur sensitizers such as thiosulfates, allyisothiourea, thiourea, thiosemicarbazide, etc. in photographic silver halide emulsions. These sulfur sensitizers are added to the silver halide emulsion prior to or during digestion.

SUMMARY OF THE INVENTION

This invention provides an improved light-sensitive silver halide photographic element comprising a support coated with a silver halide emulsion containing a hexathiocane thione sensitizer which on a mole for mole basis is more effective than conventional sulfur sensitizers, and has the basic structure

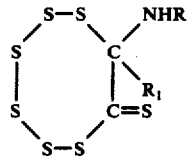

wherein R and $R_1$ are inert monovalent hydrocarbon radicals, and R is alkyl, unsaturated alkyl, or a saturated cyclic group, and $R_1$ is aryl or substituted aryl.

DETAILED DESCRIPTION OF THE INVENTION

The hexathiocane thiones of this invention may be added to silver halide emulsions prior to or during the digestion stage of preparation of said emulsion. It is believed that the ring containing 6 S atoms and 2 C atoms and the thione group are the parts of the molecule important to sensitization. The organic radicals R and $R_1$ are not particularly important, especially if they are inert. Hexathiacane-thiones decompose at high pH to give sulfur which may explain their sensitization mechanism.

These hexathiocane-thiones may be used in negative-type emulsions, and in other emulsions such as those used in the graphic arts, e.g. lithographic materials, those used in radiographic work, e.g. x-ray films, color films, and photographic films used for diffusion transfer processes and may comprise silver chloride, iodide, bromide, iodobromide, chlorobromide or iodochlorobromide. Among the hexathiocane thiones suitable for this invention the following are illustrative:

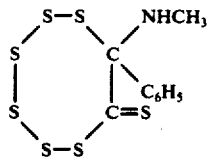

8-phenyl - 8 methyl amino - 1,2,3,4,5,6, - hexathiocane - 7 - thione.

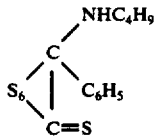

8-phenyl - 8 - butyl amino - 1,2,3,4,5,6 - hexathiocane - 7 - thione.

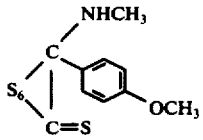

8-p-methoxy phenyl - 8 - methyl amino - 1,2,3,4,5,6 - hexathiocane - 7 - thione.

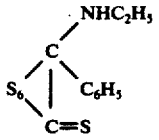

8 - phenyl - 8 - ethyl amino - 1,2,3,4,5,6, - hexathiocane - 7 - thione.

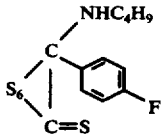

8 - p - fluorophenyl - 8 - butyl amino - 1,2,3,4,5,6 - hexathiocane - 7 - thione.

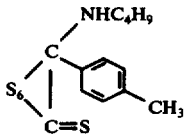

8 - p - tolyl - 8 - butyl amino - 1,2,3,4,5,6 - hexathiocane - 7 - thione.

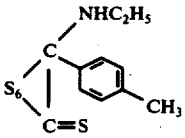

8 - p - tolyl - 8 - ethyl amino - 1,2,3,4,5,6 - hexathiocane - 7 - thione.

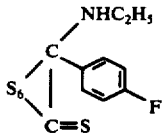

8 - p - fluorophenyl - 8 - ethyl amino - 1,2,3,4,5,6 - hexathiocane - 7 - thione.

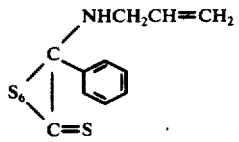

8 - phenyl - 8 - allyl amino - 1,2,3,4,5,6 - hexathiocane - 7 - thione.

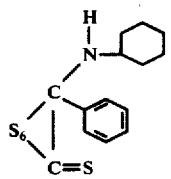

8 - phenyl - 8 - cyclohexyl amino - 1,2,3,4,5,6 - hexathiocane - 7 - thione.

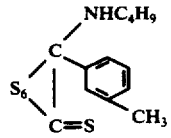

8 - m - tolyl - 8 - butyl amino - 1,2,3,4,5,6 - hexathiocane - 7 - thione.

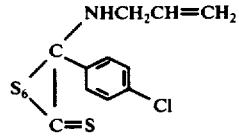

8 - p - chlorophenyl - 8 - allyl amino - 1,2,3,4,5,6 - hexathiocane - 7 - thione. Methods for the preparation of hexathiocanethiones are given by F. Asinger, Angew. Chem. Internat. Edit. Vol. 6, No. 11, p. 917-9, (1967).

As indicated, the hexathiocane thiones may be added to a variety of silver halide emulsions and said emulsions may contain optical sensitizing dyes, antifoggants and other chemical sensitizers including conventional sulfur, noble metal and reduction type sensitizers. The quantity of hexathiocane thione will, of course, depend on the particular type of emulsions and the desired effects and can vary within wide limits. The optimum amount to be added can be determined for each emulsion by simple experiment as is customary in the art of emulsion manufacture. Generally, the most suitable concentration range will be found to be from $5\times10^{-7}$ to $1.8\times10^{-5}$ moles per 1.5 moles of silver halide in the emulsion.

The following procedures and examples will serve to illustrate the invention in a more detailed manner, but they are not intended to be limiting thereto.

The compounds were added to the silver halide emulsion during, before, or after digestion or just prior to coating. Silver halide emulsions were prepared according to the following procedures:

PROCEDURE A

SILVER CHLOROBROMIDE EMULSION

A gelatino-silver chlorobromide emulsion was made by rapidly adding to an acidified gelatin solution containing 1.5 moles of potassium chloride, 1.5 moles of silver nitrate in aqueous solution. There was then added 0.6 mole of potassium bromide in aqueous solution and the mixture was allowed to ripen for 10 minutes after which 0.9 mole of potassium bromide in aqueous solution was added and the emulsion was allowed to ripen an additional 10 minutes all at 160° F. The emulsion was cooled, coagulated, washed and redispersed in the manner disclosed in Moede, U.S. Pat. No. 2,772,165.

PROCEDURE B

SILVER IODOBROMIDE EMULSION

A gelatino-silver iodobromide emulsion containing 1.6 mole per cent silver iodide was made by rapidly pouring an aqueous solution containing 1.5 moles of silver nitrate plus 3.0 moles of ammonia into an aqueous gelatin solution containing 1.5 moles of potassium bromide and the required amount of potassium iodide. The resulting emulsion was ripened for 5 minutes at 135° F. The emulsion was neutralized, cooled, coagulated, washed and redispersed in the manner disclosed in Moede, U.S. Pat. No. 2,772,165.

PROCEDURE C

MONODISPERSE SILVER IODOBROMIDE EMULSION

A gelatino-silver iodobromide emulsion containing 1.0 mole % of iodide was made by a balanced double jet method in which both soluble silver nitrate and alkali metal iodobromide salts were added to an aqueous ammoniacal gelatin solution at a temperature of 115° F. and at a constant pAg of 8.35 to produce a 0.2 micron average grain size. The emulsion was freed from soluble salts by a coagulation wash method and redispersed as disclosed in Moede, U.S. Pat. No. 2,772,165.

PROCEDURE D

SILVER CHLOROBROMIDE EMULSION CONTAINING A LEAD SALT

A gelatino-silver chlorobromide solution was made substantially as in Procedure A except for the presence of 0.2 mole % of lead nitrate in gelatin salt solution.

PROCEDURE E

SILVER IODOBROMIDE EMULSION CONTAINING A CADMIUM SALT

A gelatino-silver iodobromide emulsion containing 1.27% iodide and 0.25 cadmium ion was made by adding aqueous silver nitrate solution in two equal portions to an aqueous gelatin solution containing the required amount of potassium iodide and bromide and cadmium bromide. The precipitation was carried out at 122° F. After the first silver nitrate addition the emulsion was ripened 14 minutes and after the second addition it was ripened for 7 minutes in the presence of sufficient ammonia to convert only 13% of the silver present and the ammonia was then neutralized with sulfuric acid. The emulsion was then freed of unwanted soluble salts as described above.

PROCEDURE F

NEGATIVE TYPE EMULSION DIGESTION

To an emulsion containing silver halide equivalent to 1.5 moles of silver nitrate and prepared by Procedures A, B, C or D above there was added bulking gelatin and the temperature was raised to 110° F. The pH was adjusted to 6.5. The emulsion was heated to 125° F., and there was added $3.3 \times 10^{-6}$ mole of gold in the form of $HAuCl_4$, a conventional gold sensitizing compound, and $1.7 \times 10^{-5}$ mole of sodium thiosulfate, a conventional sulfur sensitizing compound. The emulsion was then digested for 60 minutes at 125° F. The pH was then adjusted to 5.5, coating aids including a gelatin hardener were added, and the composition was coated on a photographic quality film base, and dried in conventional manner. Said film base had been first coated on both sides with a vinylidene chloride-alkyl acrylate/itaconic acid copolymer mixed with an alkyl acrylate as described by Rawlins in U.S. Pat. No. 3,443,950, over which had been coated on both sides a thin anchoring substratum of gelatin (0.5 mg/dm²1).

PROCEDURE G

NEGATIVE TYPE EMULSION DIGESTION

To an emulsion containing silver halide equivalent to 1.5 moles of silver nitrate and prepared by Procedure E above there was added bulking gelatin and the temperature raised to 110° F. The pH was adjusted as shown in the example, the emulsion was heated to 125° F, and there was added $5.28 \times 10^{-6}$ mole of gold in the form of $HAuCl_4$ and $3.81 \times 10^{-3}$ mole of KSCN, a thiocyanate sensitizing compound. At this stage a conventional sulfur sensitizer or the hexathiocane thione sensitizers of the invention were also added. The emulsion was then digested for 120 minutes at 125° F. The emulsions were optically sensitized with optical sensitizing dyes of the type disclosed in U.S. Pat. No. 2,493,748.

The pH was then adjusted to 5.5, coating aids including a gelatin hardener were added, and the composition coated on a photographic quality film base such as that described in Procedure F and dried in a conventional manner.

Coated and dried samples were tested, fresh (F) and after being oven aged (0) for 7 days at 120° F. and 65% relative humidity, using the methods described below:

METHOD 1

A coated and dried sample was exposed for $10^{-6}$ seconds in a sensitometer, through a $\sqrt{2}$ step wedge, by means of a lamp which provided an exposure of 29 meter-candle-seconds and developed for 90 seconds at 80° F. in a commerical, high contrast, lithographic hydroquinone/formaldehyde bisulfite type developer, fixed, washed and dried.

METHOD 2

A coated and dried sample was exposed for 4 seconds in a sensitometer through a $\sqrt{2}$ step wedge by means of a lamp which provided an exposure of 4470 meter-candle-seconds, and developed for 22 seconds at 100° F. in a conventional hydroquinone-phenidone type developer, fixed, washed and dried.

METHOD 3

A coated and dried sample was exposed for $10^{-4}$ seconds in a sensitometer, through a $\sqrt{2}$ step wedge, by means of a lamp which provided an exposure of 130 meter-candle-seconds, developed for 60 seconds at 80° F. in a conventional hydroquinone-phenidone type developer, fixed, washed and dried. 1X/3X fog samples were processed for 1 minute and 3 minutes as above with no exposure.

EXAMPLE 1

Gelatino-silver chlorobromide emulsions were prepared as described in Procedure A and digested as in Procedure F but for the variations in digestion pH and sulfur sensitizer additions indicated in Table 1. The coatings were tested as described in Method 1 and 2. The results are shown in Table 1 below.

TABLE 1

| | | Method 1 | | Method 2 | | | | Digestion Variation Sulfur Sensitizer |
|---|---|---|---|---|---|---|---|---|
| Ctg. No. | Test Age | Dmin | Dmax | Dmin | Dmax | Dens. Stp. 2 | Dig pH | Moles/1.5 Moles of Silver Halide |
| 1 | F | .03 | .32 | .03 | 1.03 | .09 | 7.5 | $1.74 \times 10^{-5} S_2O_3^{-2}$ |
| | O | .03 | .08 | .04 | .68 | .05 | | (Control) |
| 2 | F | .03 | 1.67 | .04 | 2.64 | .27 | 5.2 | $3.4 \times 10^{-6}$ |
| | O | .04 | 1.36 | .04 | 2.59 | .46 | | Compound 1 |
| 3 | F | .04 | 1.97 | .03 | 2.74 | .55 | 5.4 | ↓ |
| | O | .04 | 1.70 | .04 | 2.55 | .83 | | ↓ |
| 4 | F | .04 | 2.10 | .04 | 3.06 | .74 | 5.5 | ↓ |
| | O | .03 | 1.88 | .03 | 3.22 | 1.04 | | ↓ |
| 5 | F | .09 | 2.16 | .05 | 2.60 | 1.06 | 5.9 | ↓ |
| | O | .06 | 2.03 | .07 | 2.68 | 1.44 | | ↓ |
| 6 | F | .10 | 2.04 | .06 | 2.62 | 1.14 | 6.2 | ↓ |
| | O | .08 | 2.04 | .08 | 2.65 | 1.39 | | ↓ |
| 7 | F | .09 | 2.55 | .06 | 2.84 | 1.18 | 6.7 | ↓ |
| | O | .09 | 2.01 | .09 | 2.75 | 1.33 | | ↓ |
| 8 | F | .09 | 2.07 | .06 | 2.70 | 1.07 | 7.1 | ↓ |
| | O | .08 | 1.72 | .03 | 2.51 | 1.23 | | ↓ |
| 9 | F | .07 | 2.12 | .05 | 3.39 | .99 | 7.45 | ↓ |
| | O | .09 | 1.61 | .03 | 3.21 | 1.17 | | ↓ |

Data show that the hexathiocane thione sensitizer (Compound 1) is a stronger sensitizer than the conventional sulfur sensitizer (thiosulfate) over a wide range of digestion pH. The best response for this concentration of Compound 1 and said emulsion is at a pH of 5.5.

EXAMPLE 2

Gelatino-silver chlorobromide emulsions were prepared by the procedures followed in Example 1 except for the variation in sulfur sensitizer addition indicated in Table II. The digestion pH was maintained at 6.5. The coated and dried samples were tested as described in Method 2. The results listed in Table II show a concentration range of $7.5 \times 10^{-7}$ to $2 \times 10^{-6}$ moles of Compound 1 to be useful in silver chlorobromide emulsions at a digestion pH of 6.5.

TABLE II

| Ctg. No. | Test Age | Dmin | Dmax | Dens. Step. 2 | Digestion Variation: Moles of Sulfur Sensitizer/1.5 Moles of Silver Halide | |
|---|---|---|---|---|---|---|
| 1 | F | .05 | .70 | .05 | $1.74 \times 10^{-5}$ | $S_2O_3^{-2}$ |
| | O | .03 | .58 | .05 | (Control) | |
| 2 | F | .09 | 1.37 | .70 | $2 \times 10^{-6}$ | Compound 1 |
| | O | .08 | 2.91 | 1.35 | | |
| 3 | F | .04 | 1.99 | .40 | $1 \times 10^{-6}$ | " |
| | 0 | .04 | 1.81 | .40 | | |
| 4 | F | .04 | 1.11 | .11 | $7.5 \times 10^{-7}$ | " |

EXAMPLE 3

Gelatino-silver chlorobromide emulsions were prepared by the procedures following in Example 1 but with the variations in gold and sulfur sensitizer addition listed in Table III. The coated and dried samples were tested as in Example 2 and the sensitometric results are shown in Table III.

TABLE III

| Ctg. No. | Test Age | Dmin | Dmax | Dens. Stp. 2 | Dens. Stp. 10 | Digestion Variation: Au Moles/1.5 Moles of Silver Halide | S-Sens. Moles/1.5 Moles of Silver Halide | |
|---|---|---|---|---|---|---|---|---|
| 1 | F | .03 | 1.72 | .46 | 1.47 | $3.3 \times 10^{-6}$ | $1.75 \times 10^{-5}$ | $S_2O_3^{-2}$ |
| | 0 | .04 | 1.64 | .52 | 1.47 | | (Control) | |
| 2 | F | .05 | 2.39 | .58 | 2.18 | $3.3 \times 10^{-6}$ | $3.4 \times 10^{-6}$ | Compd. 1 |
| | 0 | .04 | 2.25 | .85 | >2.00 | | | |
| 3 | F | .02 | 2.63 | .01 | 1.72 | None | $3.4 \times 10^{-6}$ | " |
| | 0 | .03 | 1.79 | .05 | 1.45 | | | |
| 4 | F | .03 | 2.60 | .02 | 2.04 | None | $3.4 \times 10^{-6}$ | Compd. 2 |
| | 0 | .03 | 2.40 | .05 | 2.10 | | | |
| 5 | F | .04 | 2.79 | .25 | 2.29 | $3.3 \times 10^{-6}$ | $5.1 \times 10^{-6}$ | " |
| | 0 | .03 | 2.46 | .32 | 2.28 | | | |

Data show that in the absence of a gold sensitizer, Compounds 1 and 2 gave good Dmax and shoulder speed (Step 10) but lower toe speed (Step 2) than the conventional thiosulfate sensitizer. This indicates compounds 1 and 2 produce greater contrast.

EXAMPLE 4

Gelatino-silver iodobromide emulsions were prepared using Procedure B and digested as in Procedure F but with the digestion variations indicated in Table IV. The coated and dried samples were tested by Methods 1 and 2. The sensitometric results recorded in Table IV show that compound 1 is a strong sensitizer in iodobromide emulsions with the best response at a digestion pH of 5 to 5.6.

TABLE IV

| Ctg. No. | Test Age | Method 1 Dmin | Method 1 Dmax | Method 1 Rel. Speed (D = 1.0) | Method 2 Dmin | Method 2 Dmax | Method 2 Rel. Speed (D = 2.0) | Dig. pH | Digestion Variation: Moles of Sulfur Sensitizer/1.5 Moles of Silver Halide |
|---|---|---|---|---|---|---|---|---|---|
| 1 | F | .04 | 1.47 | 100 | .03 | 2.24 | 100 | 7.1 | $1.74 \times 10^{-5}$ $S_2O_3^{-2}$ |
| | O | .04 | 1.55 | 155 | .03 | 2.22 | 100 | | (Control) |
| 2 | F | .03 | 2.52 | 570 | .03 | 2.94 | 638 | 5.0 | $3.4 \times 10^{-6}$ |
| | O | .04 | 2.19 | 662 | .04 | 2.50 | 283 | | Compound 1 |
| 3 | F | .04 | 2.48 | 614 | .04 | 2.92 | 674 | 5.05 | ↓ |
| | O | .04 | 2.18 | 686 | .04 | 2.65 | 383 | | |
| 4 | F | .05 | 2.69 | 1112 | .06 | 2.93 | 1696 | 5.6 | |
| | O | .05 | 2.31 | 1912 | .06 | 2.42 | 2568 | | |
| 5 | F | .11 | 2.77 | 1316 | .09 | 3.14 | >3144 | 5.85 | |
| | O | .13 | 2.33 | 2112 | .11 | 2.37 | 3144 | | |
| 6 | F | .11 | 2.46 | 972 | .11 | 2.90 | 2648 | 6.3 | |
| | O | .14 | 2.16 | 1052 | .13 | 2.25 | 1864 | | |
| 7 | F | .11 | 2.77 | 1400 | .11 | 3.10 | >3144 | 6.5 | |
| | O | .15 | 2.34 | 2128 | .13 | 2.44 | 3144 | | |
| 8 | F | .13 | 2.82 | 1376 | .12 | 3.02 | 3144 | 6.8 | |
| | O | .17 | 2.33 | 1800 | .15 | 2.23 | 3144 | | |
| 9 | F | .11 | 2.35 | | .11 | 2.67 | | 7.0 | |
| | O | .14 | 2.11 | 1340 | .11 | 2.19 | 1240 | | |

EXAMPLE 5

Gelatino-silver iodobromide emulsions were prepared as in Procedure B and digested as in Procedure F but with the digestion variation indicated in Table V. The coated and dried samples were tested as in Method 2. The results, listed in Table V, show that a concentration range of $5 \times 10^{-7}$ to $2 \times 10^{-6}$ moles of compound 1/1.5 moles of silver halide is useful in silver iodobromide emulsions at a digestion pH of 6.5.

TABLE V

| Ctg. No. | Test Age | Dmin | Dmax | Dens. Stp. 2 | Digestion Variations: Moles of Sulfur Sensitizer/1.5 Moles of Silver Halide | |
|---|---|---|---|---|---|---|
| 1 | F | .05 | 2.75 | .05 | $1.74 \times 10^{-5}$ | $S_2O_3^{-2}$ |
| | O | .03 | 2.47 | .06 | (Control) | |

TABLE V-continued

| Ctg. No. | Test Age | Dmin | Dmax | Dens. Stp. 2 | Digestion Variations: Moles of Sulfur Sensitizer/1.5 Moles of Silver Halide | |
|---|---|---|---|---|---|---|
| 2 | F | .19 | 3.45 | 2.63 | $2\times10^{-6}$ | Compound 1 |
| | O | .16 | 3.03 | 2.66 | | |
| 3 | F | .06 | 3.35 | .31 | $1\times10^{-6}$ | " |
| | O | .05 | 3.03 | .33 | | |
| 4 | F | .04 | 2.97 | .09 | $7.5\times10^{-7}$ | " |
| | O | .03 | 2.58 | .08 | | |
| 5 | F | .04 | 2.87 | .06 | $5\times10^{-7}$ | " |
| | O | .03 | 2.51 | .07 | | |

EXAMPLE 6

Gelatino-silver iodobromide emulsions were prepared and digested as described in Example 5 except for the digestion variations listed in Table VI. The coated and dried samples were tested as in Example 5. Results listed in Table VI show that Compounds 1 and 2 are good sensitizers for gelatino-silver iodobromide and give better performance than even a greater amount of the conventional sulfur sensitizer (thiosulfate) whether or not a gold sensitizer is present.

TABLE VI

| Ctg. No. | Test Age | Dmin | Dmax | Dens. Stp. 2 | Digestion Variation: $Au^{+3}$ moles/1.5 moles of Silver Halide | S-Sensitizer Moles/1.5 moles of Silver Halide | |
|---|---|---|---|---|---|---|---|
| 1 | F | .03 | 1.61 | .04 | $3.3\times10^{-6}$ | $1.74\times10^{-5}$ (Control) | $S_2O_3^{-2}$ |
| | O | .05 | 1.51 | .12 | | | |
| 2 | F | .03 | 2.04 | .06 | $3.3\times10^{-6}$ | $6.8\times10^{-7}$ | Compd. 1 |
| | O | .05 | 1.78 | .15 | | | |
| 3 | F | .04 | 2.21 | .95 | $3.3\times10^{-6}$ | $3.4\times10^{-6}$ | " |
| | O | .06 | 1.74 | 1.37 | | | |
| 4 | F | .05 | 2.77 | .66 | None | $3.4\times10^{-6}$ | |
| | O | .04 | 2.27 | 1.33 | | | |
| 5 | F | .03 | 1.76 | .08 | $3.3\times10^{-6}$ | $6.8\times10^{-7}$ | Compd. 2 |
| | O | .03 | 1.47 | .38 | | | |
| 6 | F | .11 | 2.27 | .49 | $3.3\times10^{-6}$ | $3.4\times10^{-6}$ | " |
| | O | .05 | 2.00 | .99 | | | |
| 7 | F | .09 | 3.07 | .28 | None | $3.4\times10^{-6}$ | " |
| | O | .04 | 2.47 | .85 | | | |
| 8 | F | .09 | 2.39 | 1.08 | $3.3\times10^{-6}$ | $5.1\times10^{-6}$ | " |
| | O | .14 | 1.79 | 1.20 | | | |

EXAMPLE 7

Gelatino-silver chlorobromide lead salt emulsions were prepared by Procedure D and digested as in Procedure F with the digestion variations listed in Table VII. The coated and dried samples were tested as in Method 1. Data listed in Table VII shown Compound 4 to give a greater response than the conventional sulfur sensitizer (Control).

TABLE VII

| Ctg. No. | Test Age | Dmin | Dmax | Dens. Stp. 2 | Digestion Variation: Dig. pH | Sensitizer Moles/1.5 moles of Silver Halide |
|---|---|---|---|---|---|---|
| 1 | F | .06 | .91 | .18 | 7.3 | $1.75\times10^{-5}$ (Control) | $S_2O_3^{-2}$ |
| | O | .04 | .84 | .19 | | | |
| 2 | F | .16 | 1.25 | .33 | 7.3 | $1.39\times10^{-5}$ | Compd. 4 |
| | O | .15 | 1.18 | .42 | | | |

EXAMPLE 8

Gelatino-silver iodobromide emulsions containing 0.25 mole % cadmium were prepared by Procedure E and digested as in Procedure G with the digestion variations listed in Table VIII. The coated and dried samples were tested using Method 3 and the results indicated in Table VIII show that a much smaller amount of Compound 1 gives an improved response over the thiosulfate compound (Control).

TABLE VIII

| Ctg. No. | 1X/3X Fog | Fog | Rel. Speed (Dens.= 1.3) | Dmax | Dig. pH | Digestion Variation: Moles of Sulfur Sens./1.5 moles of Silver Halide | |
|---|---|---|---|---|---|---|---|
| 1 | 08/16 | .08 | 100 | 2.92 | 5.2 | $1.6\times10^{-5}$ | $S_2O_3^{-2}$ (Control) |
| 2 | 03/05 | .05 | 125 | 3.14 | 5.2 | $5\times10^{-7}$ | Comp. 1 |

EXAMPLE 9

Monodisperse gelatino silver iodobromide emulsions were prepared as in Procedure C and digested as in Procedure F with the variations listed in Table IX. The coated and dried samples were then tested by Method 1 and 2 respectively and the results listed in Table IX.

Data show Compounds 1, 2 and 3 gave greater response than thiosulfate at equimolar concentrations.

TABLE IX

| Ctg. No. | Test Age | Method 1 D-min | Method 1 D-max | Method 2 Dmin | Method 2 Dmax | Method 2 Dens. Stp.2 | Ctg. pH | Digestion Variations: Au $\times 10^{-6}$ moles /1.5 moles of Silver Halide | Digestion Variations: S-Sens. moles /1.5 moles of Silver Halide |
|---|---|---|---|---|---|---|---|---|---|
| 1 | F | .04 | .74 | .05 | 2.47 | .02 | 6.8 | 3.3 | $1.74 \times 10^{-5}$ $S_2O_3^{-2}$ (Control) |
| | O | .04 | .72 | .03 | 2.70 | .00 | | | |
| 2 | F | .24 | 1.07 | .07 | 5.78 | .64 | 7.0 | 3.3 | $1.8 \times 10^{-5}$ Compound 1 |
| | O | .06 | 1.00 | .08 | 5.56 | .65 | | | |
| 3 | F | .11 | 3.40 | .05 | 5.78 | .35 | 7.0 | 3.3 | $1.8 \times 10^{-5}$ Compound 2 |
| | O | .04 | .93 | .06 | 5.61 | .36 | | | |
| 4 | F | .17 | .61 | .05 | 5.78 | .19 | 7.0 | None | $1.8 \times 10^{-5}$ Compound 3 |
| | O | | | .04 | 5.60 | .12 | | | |
| 5 | F | .28 | 1.15 | .08 | 5.45 | .49 | 7.0 | 3.3 | $1.8 \times 10^{-5}$ Compound 3 |
| | O | .06 | .82 | .10 | 5.28 | .39 | | | |

EXAMPLE 10

A monodisperse gelatino-silver iodobromide emulsion was prepared as in Procedure C, digested as in Procedure F and divided into 3 parts. To the first part was added, after digestion or just prior to coating, $3.4 \times 10^{-4}$ moles of compound 1, to the second was added $1.74 \times 10^{-5}$ mole of thiosulfate compound and the third served as the control. The coated and dried samples were tested as in Method 2 and sensitometric results are listed in Table X. Data show that normal sulfur sensitizers such as $Na_2S_2O_3$ do not improve speed (i.e. sensitize) but rather reduce speed when added after digestion or just prior to coating. However, hexathiocane thiones, such as Compound 1, when added after digestion or just prior to coating are useful to give much greater Dmax and contrast while other sulfur sensitizers such as sodium thiosulfate are not.

TABLE X

| Ctg. No. | Test Age | Dmin | Dmax | Rel. Speed (D=1.0) | Contrast (St. Line) | Compounds added after Digestion or prior to coating |
|---|---|---|---|---|---|---|
| 1 | F | .03 | 2.63 | 100 | 1.51 | None - control |
| | 3 wk NA. | .04 | 2.40 | 98 | | |
| | O | .04 | 2.40 | 13 | | |
| 2 | F | .02 | 3.90 | 2 | 3.5 | $3.4 \times 10^{-4}$ moles compound 1/1.5 moles of silver halide |
| | 3 wk NA. | .03 | 3.87 | 2 | | |
| | O | .04 | 5.34 | 8.5 | | |
| 3 | F | .05 | 1.43 | 31.5 | .56 | $1.74 \times 10^{-5}$ moles of thiosulfate/ 1.5 of silver halide. |
| | 3 wk NA. | .05 | 1.44 | 37 | | |

As indicated in the various examples these hexathiocane thiones may be used in silver halide systems in conjunction with known sensitizers i.e., sulfur and noble metal salt compounds. Reducing agents may also be used e.g., stannous salts, compounds which sensitize by development acceleration, e.g., polyoxyethylene compounds, and the polyhedral boranes disclosed in Bigelow, U.S. Pat. Nos. 3,779,777 and 3,761,275. In addition, optical sensitizing dyes can be used in silver halide emulsion systems along with hexathiocane thiones of this invention.

The sensitizers of the invention can be added to photographic silver halide emulsions using any of the well-known techniques in emulsion making. For example, they can be dissolved in a suitable solvent such as ethanol or methanol and added to the silver halide emulsion, or the solids can be added directly to the emulsion since many of them are sparingly water-soluble. The solvent should be selected so that it has no harmful effect upon the emulsion, and generally solvents or diluents which are miscible with water are to be preferred.

Silver halide emulsions sensitized according to this invention can also contain conventional additives such as plasticizers for the colloid carrier in which the silver halide crystals are dispersed, antifoggants such as thiazoles, triazoles, tetrazaindenes and the like, coating aids, hardeners, etc. The colloid carrier can be any macromolecular, water-permeable colloid known to be suitable for this purpose, such as gelatin.

The silver halide emulsions of this invention may be coated on any suitable support including photographic quality paper and transparent film. For example, the cellulosic supports such as cellulose nitrate, cellulose acetate, cellulose triacetate, cellulose mixed esters, etc., may be used. Polymerized vinyl compounds, e.g., copolymerized vinyl acetate and vinyl chloride, polystyrene, and polymerized acrylates may also be used; also the film formed from certain polyesters, preferably those obtainable by condensing terephthalic acid or dimethyl terephthalate with diethylene glycol.

I claim:

1. A photographic element comprising a support coated with a light-sensitive silver halide emulsion containing a sensitizing amount of a hexathiocane thione sensitizer which has the basic structure

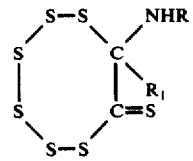

wherein R is a member of the group consisting of alkyl, unsaturated alkyl, and a saturated cyclic group, and $R_1$ is aryl or substituted aryl.

2. The photographic element of claim 1 wherein the sensitizer is employed in an amount of from $5 \times 10^{-7}$ to $1.8 \times 10^{-5}$ moles per 1.5 moles of silver halide in the emulsion.

3. The photographic element of claim 1 wherein the sensitizer is 8-phenyl - 8 methyl amino - 1,2,3,4,5,6, - hexathiocane - 7 - thione and has the formula:

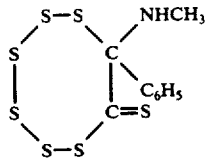

4. The photographic element of claim 1 wherein the sensitizer is 8-phenyl - 8 - butyl amino - 1,2,3,4,5,6 - hexathiocane - 7 - thione and has the formula:

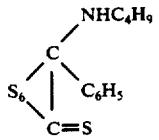

5. The photographic element of claim 1 wherein the sensitizer is 8-p-methoxy phenyl - 8 - methyl amino - 1,2,3,4,5,6 - hexathiocane - 7 - thione and has the formula:

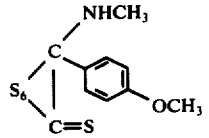

6. The photographic element of claim 1 wherein the sensitizer is 8 - phenyl - 8 - ethyl amino - 1,2,3,4,5,6 - hexathiocane - 7 - thione and has the formula:

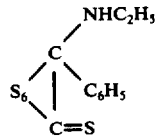

7. The photographic element of claim 1 wherein the sensitizer is 8 - p - fluorophenyl - 8 -butyl amino - 1,2,3,4,5,6 - hexathiocane - 7 - thione and has the formula:

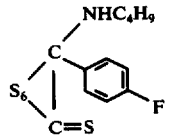

* * * * *